US007114469B1

(12) United States Patent
Taylor

(10) Patent No.: US 7,114,469 B1
(45) Date of Patent: Oct. 3, 2006

(54) COOLING SYSTEM FOR A MARINE PROPULSION ENGINE

(75) Inventor: Christopher J. Taylor, Kiel, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/137,470

(22) Filed: May 25, 2005

(51) Int. Cl.
*F01P 7/14* (2006.01)

(52) U.S. Cl. ..... 123/41.08; 123/41.82 R; 123/88 C; 123/195 P

(58) Field of Classification Search ..... 123/41.08, 123/41.82 R, 41.74, 41.33, 41.29, 195 P, 123/41.31; 440/88 C, 88 D, 88 G
See application file for complete search history.

(56) References Cited

U.S. PATENT DOCUMENTS

| | | | | |
|---|---|---|---|---|
| 5,769,038 | A | 6/1998 | Takahashi et al. | 123/41.82 R |
| 5,904,605 | A | 5/1999 | Kawasaki et al. | 440/88 |
| 5,937,801 | A | 8/1999 | Davis | 123/41.33 |
| 5,937,802 | A | 8/1999 | Bethel et al. | 123/41.74 |
| 5,970,926 | A | 10/1999 | Tsunoda et al. | 123/41.29 |
| 6,135,833 | A | 10/2000 | Tsunoda | 440/88 |
| 6,331,127 | B1 | 12/2001 | Suzuki | 440/88 |
| 6,394,057 | B1 | 5/2002 | Fukuoka et al. | 123/195 P |
| 6,561,140 | B1 | 5/2003 | Nagashima | 123/41.08 |
| 6,682,380 | B1 | 1/2004 | Irwin et al. | 440/88 C |
| 6,821,171 | B1 * | 11/2004 | Wynveen et al. | 440/88 C |
| 2004/0127116 | A1 | 7/2004 | Tawa et al. | 440/88 C |
| 2004/0192126 | A1 | 9/2004 | Tawa et al. | 440/88 C |

* cited by examiner

*Primary Examiner*—Tony M. Argenbright
*Assistant Examiner*—Katrina Harris
(74) *Attorney, Agent, or Firm*—William D. Lanyi

(57) ABSTRACT

A cooling system for a marine engine divides a flow of cooling water into first and second streams downstream of a pump. The first stream flows through a first cooling system which is controlled by a pressure sensitive valve. The second stream flows through a second cooling system which is controlled by a temperature sensitive valve.

14 Claims, 3 Drawing Sheets

COOLING SYSTEM FOR A MARINE PROPULSION ENGINE

BACKGROUND OF THE INVENTION

1. Field of the Invention

The present invention is generally related to a cooling system for a marine propulsion engine and, more specifically, to a cooling system which incorporates a pressure responsive valve in a first cooling system and a temperature responsive valve in a second cooling system, wherein the first and second cooling systems are connected in parallel with each other.

2. Description of the Related Art

Many different types of engine cooling systems are known to those skilled in the art. More specifically, many different types of cooling systems for marine engines are known.

U.S. Pat. No. 5,769,038, which issued to Takahashi et al. on Jun. 23, 1998, describes a liquid cooling system for an engine. The liquid cooling arrangement for an internal combustion engine has a cylinder block with a cylinder head connected thereto and defines at least one combustion chamber, a common exhaust passage extending through the cylinder block, and an exhaust passage leading from each combustion chamber to the common exhaust passage. The liquid cooling arrangement includes a pump for pumping cooling liquid from a cooling liquid source first through at least one passage extending through the cylinder head generally adjacent the exhaust passages leading from the combustion chambers, and through at least one passage extending through the cylinder block generally adjacent the common exhaust passage. Once the cooling liquid has passed through these passages, the cooling liquid is delivered to one or more passages extending through the cylinder head or block generally adjacent to combustion chambers. The cooling liquid then selectively passes a thermostat into a cooling liquid return line through which the cooling liquid is drained from the engine.

U.S. Pat. No. 5,904,605, which issued to Kawasaki et al. on May 18, 1999, describes a cooling apparatus for an outboard motor. The outboard motor is provided with a water cooling engine in a vertical alignment. A crankshaft is vertically disposed. The engine comprises a cylinder block, a cylinder head and an exhaust manifold into which water jackets are formed respectively and the water jackets are supplied with cooling water from a water pump disposed below the engine in a state mounted to a hull. The cooling apparatus comprises a cylinder cooling water passage for supplying cooling water from the water pump to the water jackets of the cylinder block and the cylinder head, an exhaust cooling water passage for supplying cooling water from the water pump to the water jacket of the exhaust manifold, the cylinder cooling water passage and the exhaust cooling water passage being independently disposed from each other and being joined together at downstream portions thereof. A thermostat is provided for the water jacket of the cylinder block and a sensor for detecting the temperature of a cylinder surface is provided for the water jacket of the cylinder block at a portion between the water jacket thereof and the thermostat.

U.S. Pat. No. 5,937,802, which issued to Bethel et al. on Aug. 17, 1999, discloses an engine cooling system for an internal combustion engine. It is provided with coolant paths through the cylinder block and cylinder head which are connected in serial fluid communication with each other. In parallel with the cooling path through the cylinder head, a first drain is connected in serial fluid communication with a pressure responsive valve and the path through the cylinder block. A temperature responsive valve is connected in serial fluid communication with the cylinder head path and in parallel fluid communication with the first drain. A pump is provided to induce fluid flow through the first and second coolant conduits and the first and second drains, depending on the status of the pressure responsive valve and the temperature responsive valve.

U.S. Pat. No. 5,937,801, which issued to Davis on Aug. 17, 1999, discloses an oil temperature moderator for an internal combustion engine. A cooling system is provided for an outboard motor or other marine propulsion system which causes cooling water to flow in intimate thermal communication with the oil pan of the engine by providing a controlled volume of cooling water at the downstream portion of the water path. As cooling water flows from the outlet of the internal combustion engine, it is caused to pass in thermal communication with the oil pan. Certain embodiments also provide a pressure activated valve which restricts the flow from the outlet of the internal combustion engine to the space near the oil pan. One embodiment of the cooling system also provides a dam within the space adjacent to the outer surface of the oil pan to divide that space into first and second portions. The dam further slows the flow of water as it passes in thermal communication with the oil pan.

U.S. Pat. No. 5,970,926, which issued to Tsunoda et al. on Oct. 26, 1999, describes an engine cooling system for an outboard motor. An engine includes first exhaust passages formed in a cylinder head, a second exhaust passage formed in a cylinder block and communicating with the first exhaust passages, and a cooling water passage having water jacket portions formed around the combustion chambers. The cooling water passage includes a first water jacket and a second water jacket. The cylinder head and the cylinder block are fixedly connected together by bolts. The second exhaust passage opens at a joining surface of the cylinder block along cylinders, which opening is surrounded by the bolts.

U.S. Pat. No. 6,135,833, which issued to Tsunoda on Oct. 24, 2000, describes an engine cooling system for an outboard engine. The system includes a thermostat mounted on an upper surface of a cylinder block to open and close a cooling water passage depending on the temperature of cooling water inside the cooling water passage and a relief valve mounted on the upper portion of the side wall of the cylinder block and located adjacent to the thermostat to open and close the cooling water passage depending on the pressure of cooling water inside the cooling water passage.

U.S. Pat. No. 6,331,127, which issued to Suzuki on Dec. 18, 2001, describes a marine engine for a watercraft. It includes a cooling system having a coolant supply. The coolant supply supplies an engine coolant jacket with a flow of coolant that is controlled by a temperature dependent flow control valve. The coolant supply also supplies an exhaust conduit coolant jacket independently of the engine coolant jacket.

U.S. Pat. No. 6,394,057, which issued to Fukuoka et al. on May 28, 2002, describes an arrangement of components for an engine. An exhaust system of the engine has an exhaust manifold extending along a cylinder body. At least a part of the air induction system of the engine exists to overlap with the exhaust manifold in a view along an extending axis of the exhaust manifold. A cooling system having at least two coolant passages is further provided. A coolant flow control mechanism is arranged to prevent only the coolant within one of the passages from flowing therethrough when temperature of the coolant is lower than a predetermined temperature.

U.S. Pat. No. 6,682,380, which issued to Irwin et al. on Jan. 27, 2004, describes a marine engine cooling system. The cooling system includes cylinder cooling jackets, cylinder head cooling jackets and thermostatic and pressure controls which facilitate safely operating the engine with low water flow rates.

U.S. Pat. No. 6,821,171, which issued to Wynveen et al. on Nov. 23, 2004, discloses a cooling system for a four cycle outboard engine. The system conducts water from a coolant pump through a cylinder head and exhaust conduit prior to conducting the cooling water through the cylinder block. This raises the temperature of the water prior to its entering the cooling passages of the cylinder block.

U.S. Pat. No. 6,561,140, which issued to Nagashima on May 13, 2003, describes a water cooling system for an engine. A housing unit defines a water delivery passage and a water discharge passage. Both the passages communicate with each other through a lower opening. The water delivery passage is arranged to deliver cooling water to the engine. The water discharge passage is arranged to discharge the cooling water from the engine. The discharge passage communicates with a location out of the housing unit through an upper opening. A pressure relief valve unit extends through the lower and upper openings. The pressure relief valve unit allows the cooling water in the delivery passage to move to the discharge passage when a pressure of the delivery passage becomes greater than a preset pressure.

U.S. patent application Ser. No. 10/674,815, which was filed by Tawa et al. on Oct. 1, 2003, describes a water cooled vertical engine and an outboard motor equipped therewith. Provided in a chain cover are thermostats for controlling the flow of cooling water in a cylinder block cooling water jacket and cylinder head cooling water jacket. Therefore, the thermostats can be accessed from the top of the engine for maintenance without being obstructed by the timing chain, and moreover it is easy to manipulate a drain pipe for discharging cooling water from the thermostats.

U.S. patent application Ser. No. 10/674,813, which was filed by Tawa et al. on Oct. 1, 2003, describes a water cooled vertical engine and an outboard motor equipped therewith. The engine includes an exhaust guide cooling water jacket and an exhaust manifold cooling water jacket which are formed in an engine compartment. A cylinder block cooling water jacket is formed in a cylinder block. A cylinder head cooling water jacket is formed in a cylinder head. Cooling water from a cooling water pump is supplied in parallel to an upper part and lower part of the cylinder block cooling water jacket through the exhaust guide cooling water jacket and the exhaust manifold cooling water jacket.

The patents described above are hereby expressly incorporated by reference in the description of the present invention.

It would be beneficial if a cooling system for a marine engine could be provided in which different cooling circuits of the cooling system could be individually temperature controlled so that they are not all dependent on a common thermostat. This would allow certain heat emitting portions of the engine to be cooled more rapidly under certain dynamic conditions even though other portions of the engine, and their respective cooling circuits, experience more slowly rising coolant temperatures.

SUMMARY OF THE INVENTION

A cooling system for a marine propulsion engine, made in accordance with a preferred embodiment of the present invention, comprises first and second cooling systems disposed in thermal communication with first and second heat emitting portions of the engine, respectively. A pump is configured to induce a cooling fluid to flow through the first and second cooling systems in first and second streams, respectively. First and second outlet conduits are connected in fluid communication with the first and second cooling systems, respectively, and configured to conduct the first and second streams, respectively, from the first and second cooling systems. The first cooling system is connected in fluid communication between an outlet of the pump and the first outlet conduit and the second cooling system is connected in fluid communication between an outlet of the pump and the second outlet conduit. A pressure responsive valve is connected in fluid communication with the first outlet conduit and a temperature responsive valve is connected in thermal communication with the second outlet conduit.

In a particularly preferred embodiment of the present invention, the pump is a water pump having an inlet disposed in fluid communication with a body of water. The first and second outlet conduits are configured to conduct the first and second streams, respectively, away from the first and second cooling systems and toward the body of water.

In a preferred embodiment of the present invention, it further comprises a third cooling system disposed in thermal communication with a third heat emitting portion of the engine. The third cooling system is connected in serial fluid communication with the second cooling system between the pump and the second outlet conduit. The third heat emitting portion of the engine can be a cylinder of the engine, the first heat emitting portion of the engine can be an exhaust conduit and the second heat emitting portion of the engine can be a combustion chamber of the engine.

In an alternative embodiment of the present invention, the second heat emitting portion of the engine can comprise both a cylinder within a block portion of the engine and a combustion chamber within a head portion of the engine.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
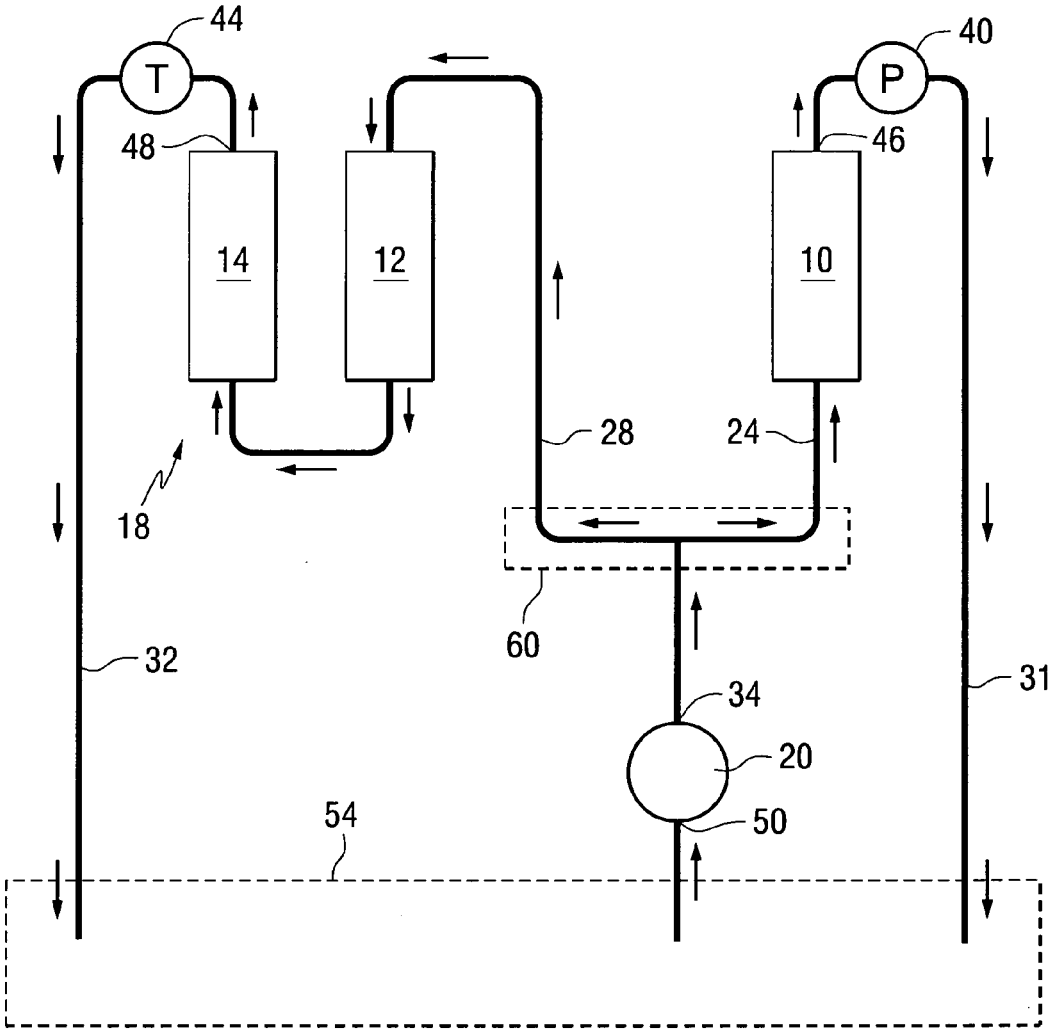
FIG. 1 is a highly simplified schematic representation of the present invention used in conjunction with an open loop cooling system.

Throughout the description of the preferred embodiment of the present invention, like components will be identified by like reference numerals.

A preferred embodiment of the present invention comprises a first cooling system 10 which is disposed in thermal communication with a first heat emitting portion of the engine. It also comprises a second cooling system which, in the embodiment shown in FIG. 1, comprises two cooling subsystems, 12 and 14, which are connected in serial fluid communication as shown. As will be described in greater detail below, the second cooling system 18 can comprise various individual cooling subsystems that are used to remove heat from various heat emitting portions of the engine, such as the cylinders and combustion chambers. The first cooling system 10, in the embodiment relating to FIG. 1, is a common exhaust conduit that can be formed as an integral part of the head of the engine. A pump 20 is configured to induce a flow of cooling fluid through the first and second cooling systems, 10 and 18, in first and second streams, 24 and 28, respectively. A first outlet conduit 31 is connected in fluid communication with the first cooling system 10 and configured to conduct the first stream away from the first cooling system 10. The first cooling system 10 is connected in fluid communication between an outlet 34 of the pump 20 and the first outlet conduit 31. A second outlet conduit 32 is connected in fluid communication with the second cooling system 18 and configured to conduct the second stream 28 away from the second cooling system 18. The second cooling system 18 is connected in fluid communication between the outlet 34 of the pump 20 and the second outlet conduit 32.

With continued reference to FIG. 1, a preferred embodiment of the present invention provides a pressure responsive valve 40 connected in fluid communication with the first outlet conduit 31. It also provides a temperature responsive valve 44 connected in thermal communication with the second outlet conduit 32.

The pressure responsive valve 40 reacts to the pressure at the outlet 46 of the first cooling system 10 while the temperature responsive valve 44 reacts to a temperature at an outlet 48 of the second cooling system 18 in a preferred embodiment of the present invention.

In the embodiment shown in FIG. 1, the pump 20 is a water pump that has an inlet 50 disposed in fluid communication with a body of water 54 which is represented by a dashed line in FIG. 1. The first outlet 31, in the embodiment shown in FIG. 1, is configured to conduct the first stream 24 away from the first cooling system 10 and toward the body of water 54. The second outlet conduit 32 is configured to conduct the second stream 28 away from the second cooling system 18 and toward the body of water 54.

The dashed line box 60 in FIG. 1 represents an adapter plate of an outboard motor. In a preferred embodiment of the present invention, the outlet 34 of the pump 20 conducts a single stream of water into the adapter plate 60 where it is divided into the first and second streams, 24 and 28.

Figure 2:
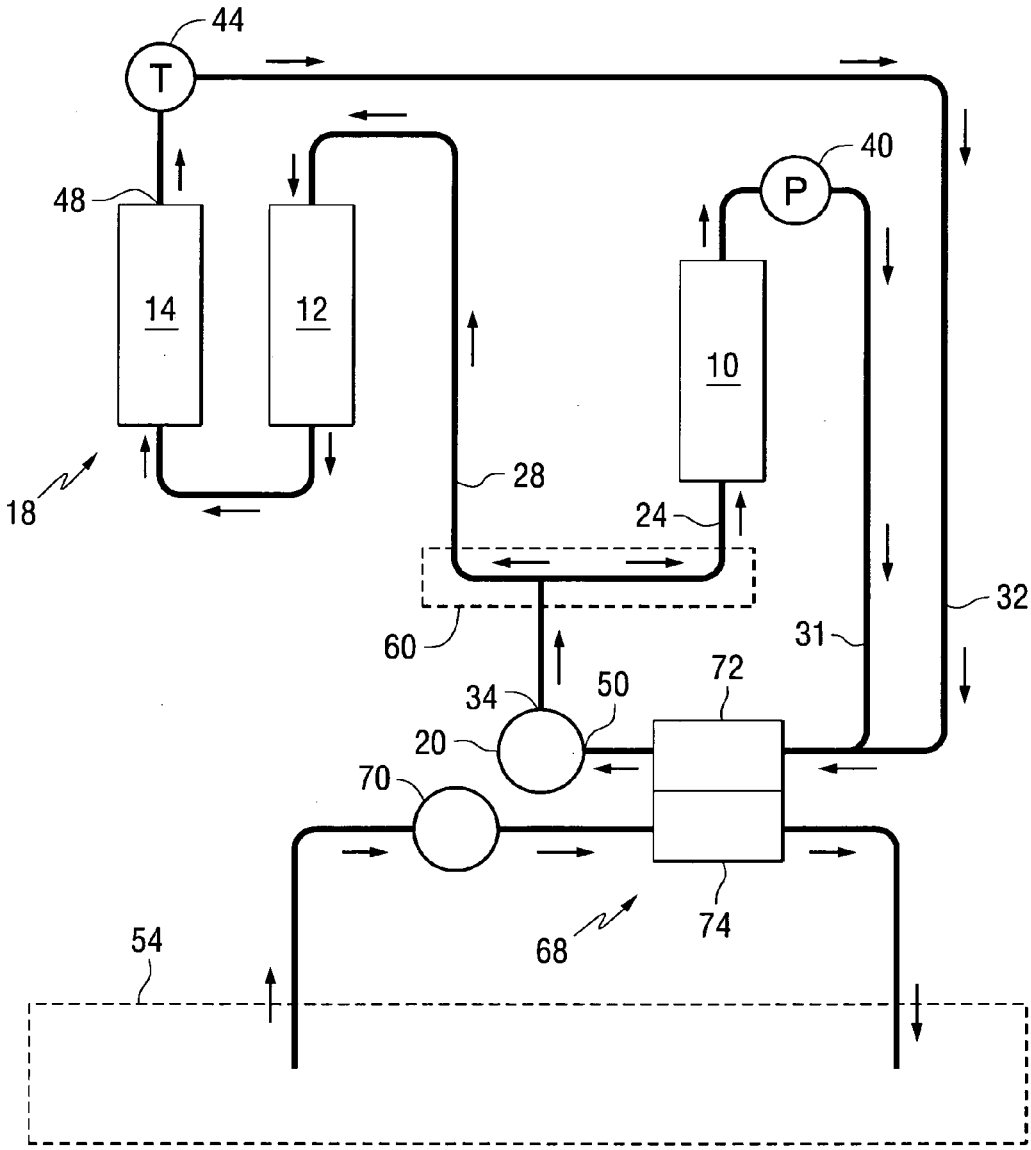
FIG. 2 is a highly simplified representation of the present invention used in conjunction with a closed loop cooling system.

FIG. 2 shows an alternative embodiment of the present invention that can be used in conjunction with a closed cooling system. In the closed cooling system of FIG. 2, a heat exchanger 68 removes heat from a closed loop of a coolant, such as ethylene glycol, that circulates through the first and second cooling systems, 10 and 18.

With continued reference to FIG. 2, a water pump 70 draws water from the body of water 54 and circulates it through the heat exchanger 68. The heat exchanger 68, as is generally known to those skilled in the art, contains a closed loop coolant passage 72 and a water coolant passage 74. An engine coolant, such as ethylene glycol, is recirculated through the upper portion of the circuit shown in FIG. 2 and through the engine coolant portion 72 of the heat exchanger 68. Water drawn from the body of water 54 is circulated by the pump 70 through the water side 74 of the heat exchanger 68 and returned to the body of water 54. The basic concepts of the present invention are similar in both embodiments shown in FIGS. 1 and 2, but FIG. 1 shows an open loop cooling system and FIG. 2 shows a closed loop cooling system.

Figure 3:
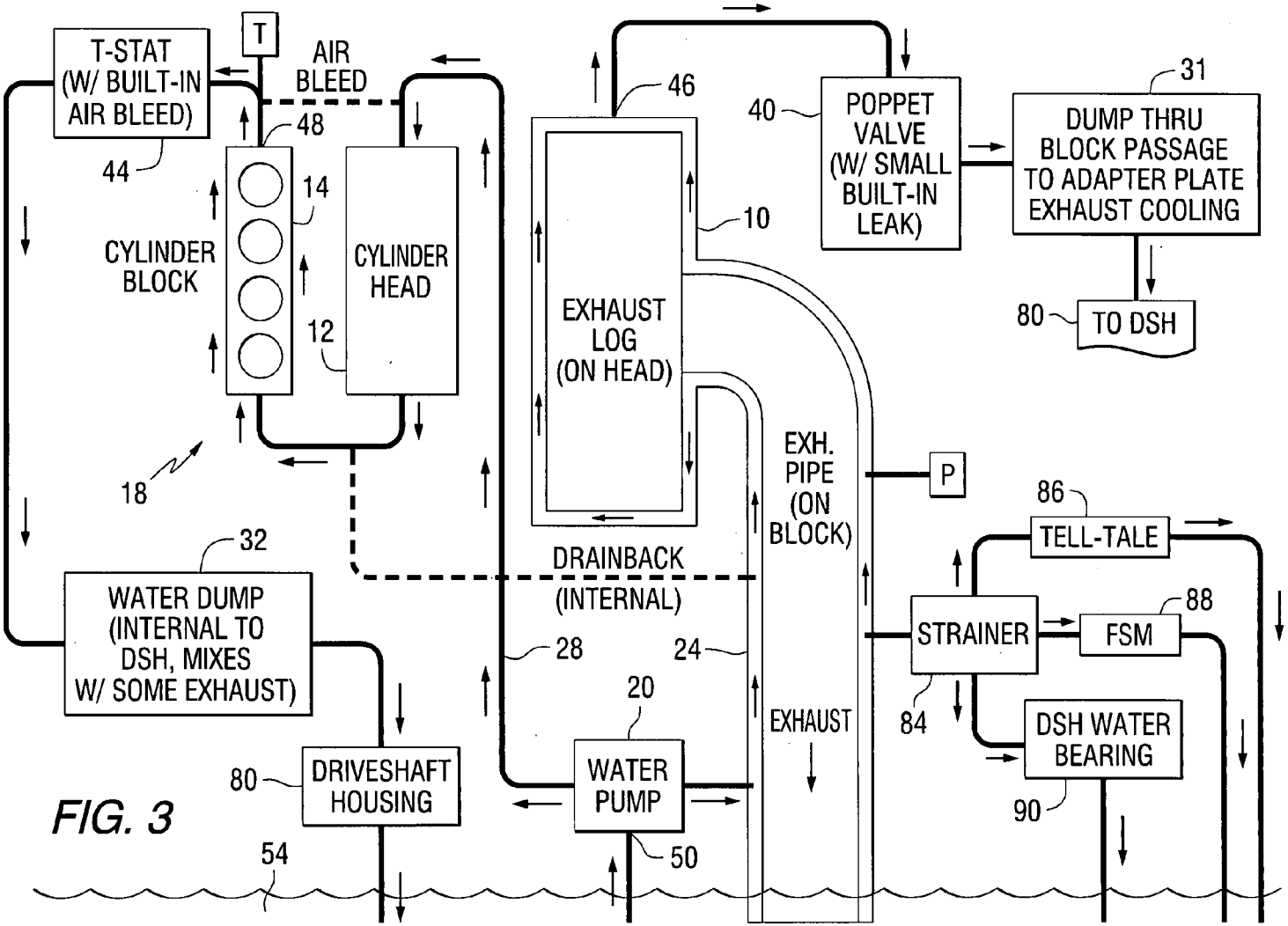
FIG. 3 is a schematic representation of a cooling system for a marine engine in conjunction with an open loop cooling system.

FIG. 3 is a slightly more detailed schematic representation of a cooling system of a marine engine made in accordance with a preferred embodiment of the present invention. FIG. 3 shows an open loop cooling system which is generally similar to the more simplified schematic shown in FIG. 1. As described above, the water pump 20 draws water from the body of water 54 and conducts it, along two streams, 24 and 28, to first and second cooling systems, 10 and 18. The second cooling system 18 includes the cylinder head cooling system 12 and the cylinder block cooling system 14 which are shown connected in series fluid communication with each other. The pressure responsive valve 40 is configured to be responsive to the pressure at the outlet 46 of the first cooling system 10. The temperature responsive valve 44 is configured to be responsive to the temperature at the outlet 48 of the second cooling system 18. The operation of the pressure responsive valve 40 and the temperature responsive valve 44 are generally independent from each other. The first outlet conduit 31 directs the flow of water from the pressure responsive valve 40 through the driveshaft housing of the outboard motor and back to the body of water 54. The second outlet conduit 32 directs the second stream 28 from the second cooling system 18 through the driveshaft housing 80 and back to the body of water 54. Other components shown in FIG. 3 include a strainer 84, a tell-tale outlet 86, a fuel system 88, and a driveshaft housing water bearing 90. After flowing through these various components, the water is returned to the body of water 54.

With reference to FIGS. 1–3, it can be seen that a preferred embodiment of the present invention provides parallel first and second streams, 24 and 28, that flow through the first and second cooling systems, 10 and 18, respectively. Because the first and second streams are parallel to each other, a pressure responsive valve 40 and a temperature responsive valve 44 can manage the flow of water through these cooling systems in a way that allows independent control of the desired temperatures in the first and second cooling systems. A system made in accordance with the preferred embodiment of the present invention allows the cooling system to react quickly to sudden changes in temperature and pressure of the two cooling systems. In other words, if a sudden change in engine speed occurs, the temperature of the exhaust conduit cooled by the first cooling system 10 will rise more suddenly than the temperature within the second cooling system 18. This sudden rise in temperature within the first cooling system 10 is generally coincident with a sudden rise in pressure within the same cooling system. As a result, the pressure responsive valve 40 is able to react to the sudden increase in pressure and open so that cooling water can flow through the first outlet conduit 31. As a result, additional cooling water is provided through the first stream 24 to the first cooling system 10 and this new flow of cooling water allows the cooling system to react quickly to the increasing temperature and maintain the temperature within the first cooling system 10 at a preselected magnitude. This occurs independently of the action of the thermally responsive valve 44 which maintains the temperature within the second cooling system 18 at a second preselected magnitude.

Although the present invention has been described in considerable detail and illustrated to show preferred embodiments, it should be understood that alternative embodiments are also within its scope.

I claim:

1. A cooling system for a marine propulsion engine, comprising:

a first cooling system disposed in thermal communication with a first heat emitting portion of said engine;

a second cooling system disposed in thermal communication with a second heat emitting portion of said engine;

a pump configured to induce a cooling fluid to flow through said first and second cooling systems in first and second streams, respectively;

a first outlet conduit connected in fluid communication with said first cooling system and configured to conduct said first stream away from said first cooling system, said first cooling system being connected in fluid communication between an outlet of said pump and said first outlet conduit;

a second outlet conduit connected in fluid communication with said second cooling system and configured to conduct said second stream away from said second cooling system, said second cooling system being connected in fluid communication between an outlet of said pump and said second outlet conduit;

a pressure responsive valve connected in fluid communication with said first outlet conduit; and a temperature responsive valve connected in thermal communication with said second outlet conduit, said first heat emitting portion of said engine being an exhaust conduit, said first cooling system comprising a first cooling branch conducting said cooling fluid serially from said pump to said exhaust conduit to said pressure responsive valve to said first outlet conduit, said second heat emitting portion of said engine being a combustion chamber of said engine, said second cooling system comprising a second cooling branch in parallel with said first cooling branch and conducting said cooling fluid serially from said pump to said combustion chamber to said temperature responsive valve to said second outlet conduit without flowing to said exhaust conduit, such that cooling fluid in said second cooling branch flows serially from said pump to said combustion chamber to said temperature responsive valve to said second outlet conduit without flowing to said exhaust conduit, and such that said temperature responsive valve controls cooling fluid flow to said combustion chamber but not to said exhaust conduit.

2. The cooling system of claim 1, wherein:

said pump is a water pump having an inlet disposed in fluid communication with a body of water.

3. The cooling system of claim 2, wherein:

said first outlet conduit is configured to conduct said first stream away from said first cooling system and toward said body of water.

4. The cooling system of claim 2, wherein:

said second outlet conduit is configured to conduct said second stream away from said second cooling system and toward said body of water.

5. The cooling system of claim 1, further comprising:

a third cooling system disposed in thermal communication with a third heat emitting portion of said engine, said third cooling system being connected in serial fluid communication with said second cooling system between said pump and said second outlet conduit.

6. The cooling system of claim 5, wherein:

said third heat emitting portion of said engine is a cylinder of said engine.

7. The cooling system of claim 1, wherein:

said first heat emitting portion of said engine is a common exhaust conduit formed in a head portion of said engine.

8. The cooling system of claim 1, wherein:

said second heat emitting portion of said engine comprises a cylinder within a block portion of said engine and a combustion chamber within a head portion of said engine.

9. A cooling system for a marine propulsion engine, comprising:

a first cooling system disposed in thermal communication with a first heat emitting portion of said engine;

a second cooling system disposed in thermal communication with a second heat emitting portion of said engine;

a pump configured to induce a cooling fluid to flow through said first and second cooling systems in first and second streams, respectively;

a first outlet conduit connected in fluid communication with said first cooling system and configured to conduct said first stream away from said first cooling system, said first cooling system being connected in fluid communication between an outlet of said pump and said first outlet conduit;

a second outlet conduit connected in fluid communication with said second cooling system and configured to conduct said second stream away from said second cooling system, said second cooling system being connected in fluid communication between an outlet of said pump and said second outlet conduit, said pump being a water pump having an inlet disposed in fluid communication with a body of water, said first outlet conduit being configured to conduct said first stream away from said first cooling system and toward said body of water, said second outlet conduit being configured to conduct said second stream away from said second cooling system and toward said body of water;

a pressure responsive valve connected in fluid communication with said first outlet conduit; and a temperature responsive valve connected in thermal communication with said second outlet conduit, said first heat emitting portion of said engine being an exhaust conduit, said first cooling system comprising a first cooling branch conducting said cooling fluid serially from said pump to said exhaust conduit to said pressure responsive valve to said first outlet conduit, said second heat emitting portion of said engine being a combustion chamber of said engine, said second cooling system comprising a second cooling branch in parallel with said first cooling branch and conducting said cooling fluid serially from said pump to said combustion chamber to said temperature responsive valve to said second outlet conduit without flowing to said exhaust conduit, such that cooling fluid in said second cooling branch flows serially from said pump to said combustion chamber to said temperature responsive valve to said second outlet conduit without flowing to said exhaust conduit, and such that said temperature responsive valve controls cooling fluid flow to said combustion chamber but not to said exhaust conduit.

10. The cooling system of claim 9, further comprising:

a third cooling system disposed in thermal communication with a third heat emitting portion of said engine, said third cooling system being connected in serial fluid communication with said second cooling system between said pump and said second outlet conduit.

11. The cooling system of claim 9, wherein:

said third heat emitting portion of said engine is a cylinder of said engine.

12. The cooling system of claim 9, wherein:

said first heat emitting portion of said engine is a common exhaust conduit formed in a head portion of said engine; and said second heat emitting portion of said engine comprises a cylinder within a block portion of said engine and a combustion chamber within a head portion of said engine.

13. A cooling system for a marine propulsion engine, comprising:

a first cooling system disposed in thermal communication with a first heat emitting portion of said engine;

a second cooling system disposed in thermal communication with a second heat emitting portion of said engine;

a pump configured to induce a cooling fluid to flow through said first and second cooling systems in first and second streams, respectively;

a first outlet conduit connected in fluid communication with said first cooling system and configured to conduct said first stream away from said first cooling system, said first cooling system being connected in fluid communication between an outlet of said pump and said first outlet conduit;

a second outlet conduit connected in fluid communication with said second cooling system and configured to conduct said second stream away from said second cooling system, said second cooling system being connected in fluid communication between an outlet of said pump and said second outlet conduit, said first heat emitting portion of said engine being a common exhaust conduit formed in a head portion of said engine, said second heat emitting portion of said engine comprising a cylinder within a block portion of said engine and a combustion chamber within a head portion of said engine;

a pressure responsive valve connected in fluid communication with said first outlet conduit; and a temperature responsive valve connected in thermal communication with said second outlet conduit, said first cooling system comprising a first cooling branch conducting said cooling fluid serially from said pump to said common exhaust conduit to said pressure responsive valve to said first outlet conduit, said second cooling system comprising a second cooling branch in parallel with said first cooling branch and conducting said cooling fluid serially from said pump to said combustion chamber to said temperature responsive valve to said second outlet conduit without flowing to said exhaust conduit, such that cooling fluid in said second cooling branch flows serially from said pump to said combustion chamber to said temperature responsive valve to said second outlet conduit without flowing to said common exhaust conduit, and such that said temperature responsive valve controls cooling fluid flow to said combustion chamber but not to said common exhaust conduit.

14. The cooling system of claim 13, wherein:

said pump being a water pump has an inlet disposed in fluid communication with a body of water, said first outlet conduit being configured to conduct said first stream away from said first cooling system and toward said body of water, said second outlet conduit being configured to conduct said second stream away from said second cooling system and toward said body of water.

* * * * *